US008651132B1

(12) United States Patent
Hu

(10) Patent No.: US 8,651,132 B1
(45) Date of Patent: Feb. 18, 2014

(54) PLASTIC FAUCET BODY WITH COPPER CONNECTING LEGS

(71) Applicant: Globe Union Industrial Corp., Taichung (TW)

(72) Inventor: Shengping Hu, Guangdong Pr (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 13/714,533

(22) Filed: Dec. 14, 2012

(30) Foreign Application Priority Data

Sep. 7, 2012 (CN) ..... 2012 2 0455548

(51) Int. Cl.
*F15B 13/00* (2006.01)
*F16K 27/06* (2006.01)
*E03C 1/04* (2006.01)

(52) U.S. Cl.
USPC ..... 137/315.12; 137/801; 4/676

(58) Field of Classification Search
USPC ..... 137/801, 624.4, 624.41, 328, 315.12; 4/775–778
See application file for complete search history.

(56) References Cited

U.S. PATENT DOCUMENTS

| | | | | |
|---|---|---|---|---|
| 3,229,710 | A * | 1/1966 | Keller, III | 137/315.13 |
| 5,865,473 | A * | 2/1999 | Semchuck et al. | 285/55 |
| 7,231,936 | B2 * | 6/2007 | Chang | 137/328 |
| 2010/0096034 | A1 * | 4/2010 | Hou | 137/801 |

* cited by examiner

*Primary Examiner* — John K Fristoe, Jr.
*Assistant Examiner* — Kevin Barss
(74) *Attorney, Agent, or Firm* — Alan Kamrath; Kamrath IP Lawfirm, P.A.

(57) ABSTRACT

A plastic faucet body with copper connecting legs contains a plastic member including two seat portions, a connecting portion, and two support feet; each support foot having an inlet and a channel; the connecting portion having at least one exit and a tunnel; two copper connecting legs, each being engaged on the each support foot and having a threaded section; wherein a bottom end of the each copper connecting leg extends a predetermined distance from the each support foot so as to define a fitting section on the each copper connecting leg; a lower coupling portion is formed on a connection zone of the each support foot and the each copper connecting leg; a plastic sleeve has at least one seal element to provide a sealing effect and to prevent water from leakage via the lower coupling portion and has a seal inner face formed on the plastic sleeve.

12 Claims, 8 Drawing Sheets

PLASTIC FAUCET BODY WITH COPPER CONNECTING LEGS

FIELD OF THE INVENTION

The present invention relates to a plastic faucet body with copper connecting legs.

BACKGROUND OF THE INVENTION

Conventional faucet comprises a faucet body, and more particularly to a H-shaped faucet body with two inlets. This H-shaped faucet body comprises two seat portions mounted on two sides thereof, a connecting portion defined between the two seat portions, and two support feet extending downwardly from two bottom ends of the two seat portions. Each support foot has an inlet formed on a bottom end thereof for flowing cold water or hot water and has a channel for communicating with each seat portion. The each seat portion is used to receive a valve member controlled by a handle. The connecting portion has at least one outlet defined on a middle section thereof so as to connect with a water pipe or a shower via a hole.

To fix the faucet body, each support foot has outer threads molded on an outer surface thereof so as to screw with a washbasin by ways of a nut, and then a cover is covered in the washbasin, thus connecting the faucet body.

It is well known that the handle is provided to control the valve member so that the hot water and the cold water flow into the at least one outlet at a desired ratio, thus controlling water temperature.

Conventional faucet body is casting molded from copper material, so sand core and sand mold are required prior to casting mold the faucet body, and copper liquid is poured, finally the sand core is removed. In addition, the faucet body is machined, including reaming, drilling, and milling. But the machining process is complicated and takes a long time. Likewise, the tools for machining the faucet body are damaged easily, and the faucet body is casting molded from copper material, thereby casing high production cost.

A conventional integrally plastic faucet body and a method for making thereof are disclosed in CN Publication No. 101664980. A faucet body is overmolded from plastic material, and two support feet are made of plastic material, wherein each support foot has a toothed component or a copper leg insert molded from copper material, thus producing the faucet body made of copper material and plastic material. However, a slit generates on a connection zone of the copper leg and the support foot, thus leaking water and having water pollution.

The present invention has arisen to mitigate and/or obviate the afore-described disadvantages.

SUMMARY OF THE INVENTION

The primary object of the present invention is to provide a plastic faucet body with copper connecting legs which is capable of overcoming the shortcomings of the conventional plastic faucet body with copper connecting legs.

To obtain the above objectives, a plastic faucet body with copper connecting legs provided by the present invention contains:

a plastic member injection molded from plastic material and includes two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end of the each copper connecting leg extends a predetermined distance from a bottom end of the each support foot so as to define a fitting section on an inner wall of the each copper connecting leg;

a lower coupling portion is formed on a connection zone of the bottom end of the each support foot and the inner wall of the each copper connecting leg;

a plastic sleeve, at least one part of which is engaged with the fitting section of the each copper connecting leg, the plastic sleeve has at least one seal element fitted on an outer wall thereof so as to provide a sealing effect and to prevent water from leakage via the lower coupling portion and has a seal inner face formed on an inner wall of the plastic sleeve.

Unlike conventional faucet body with copper connecting legs, a length of the each copper connecting leg of the prevent invention is longer than that of the each support foot of the prevent invention so that the each copper connecting leg has the fitting section, and the connection zone of the bottom end of the each support foot and the inner wall of the each copper connecting leg (i.e., the lower coupling portion) is moved to a more upper position. Accordingly, when the fitting section of the each copper connecting leg connects with the plastic sleeve, one or two seal elements of the plastic sleeve are used to prevent water, flowing through the channel of the each support foot, from contacting with the lower coupling portion, thus avoiding water from leakage via the lower coupling portion.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
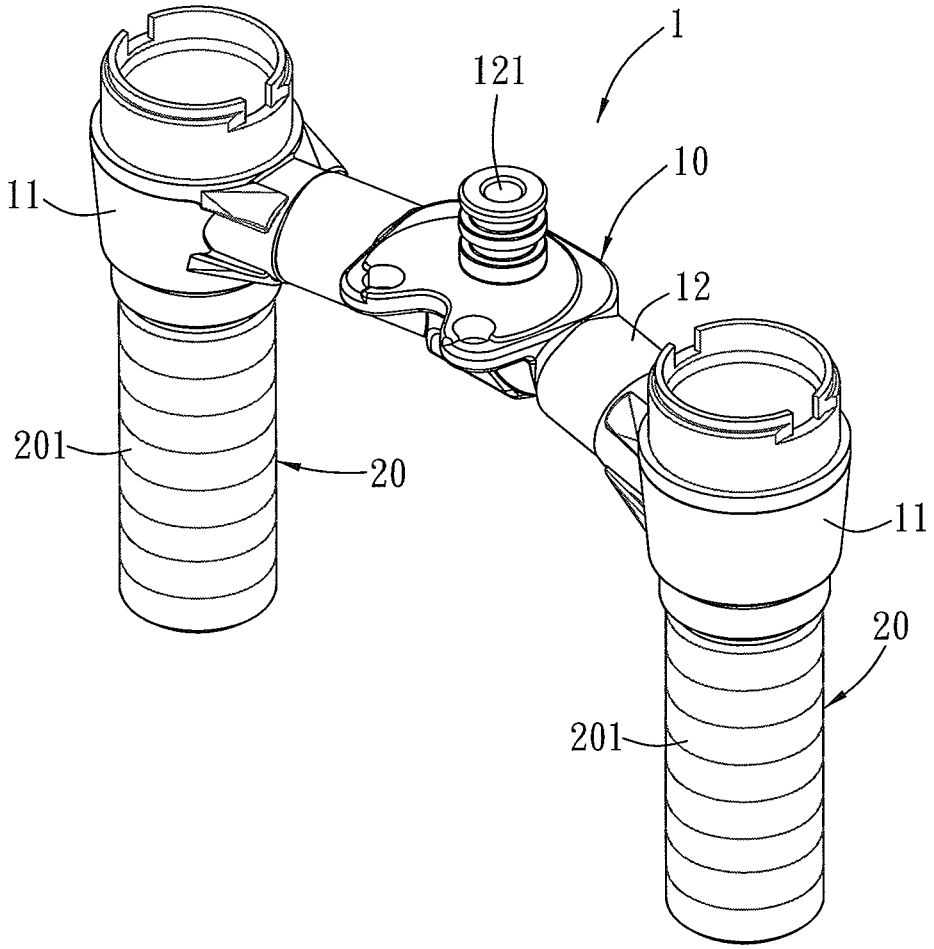
FIG. 1 is a perspective view showing the assembly of a plastic faucet body with copper connecting legs according to a first embodiment of the present invention.
Figure 2:
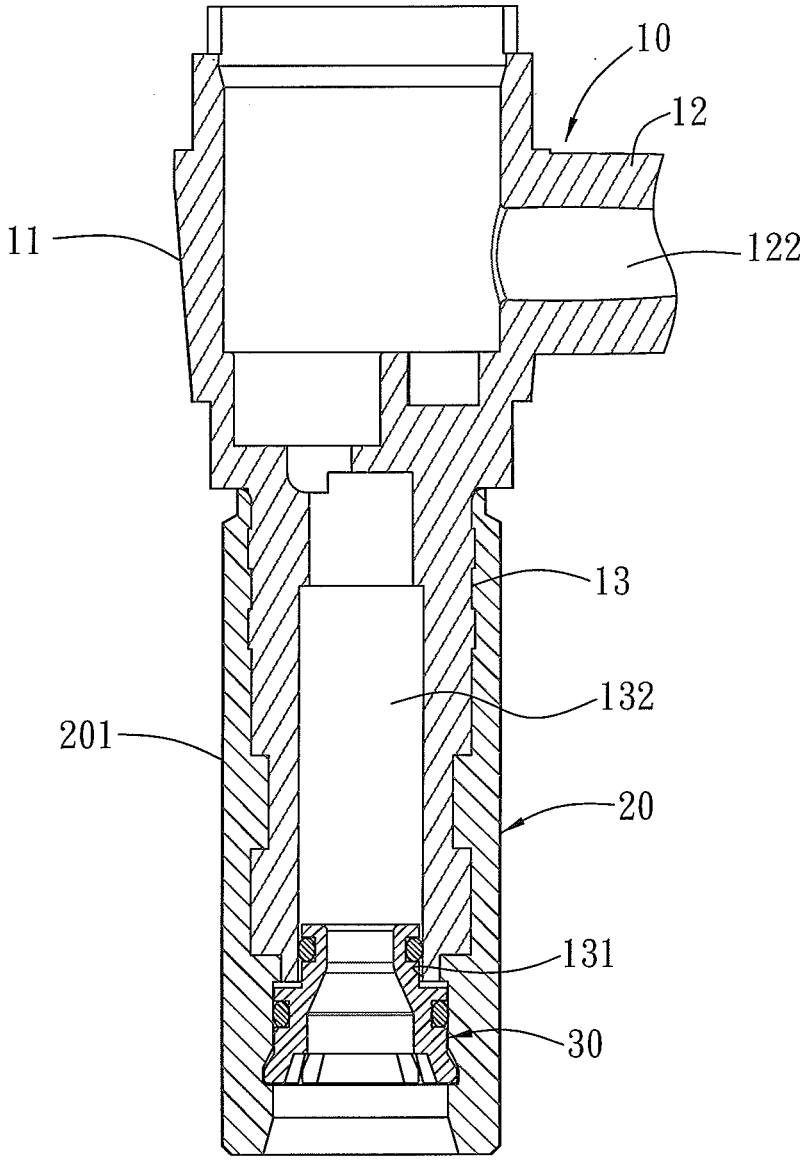
FIG. 2 is a cross sectional view showing the assembly of a part of the plastic faucet body with copper connecting legs according to the first embodiment of the present invention.
Figure 3:
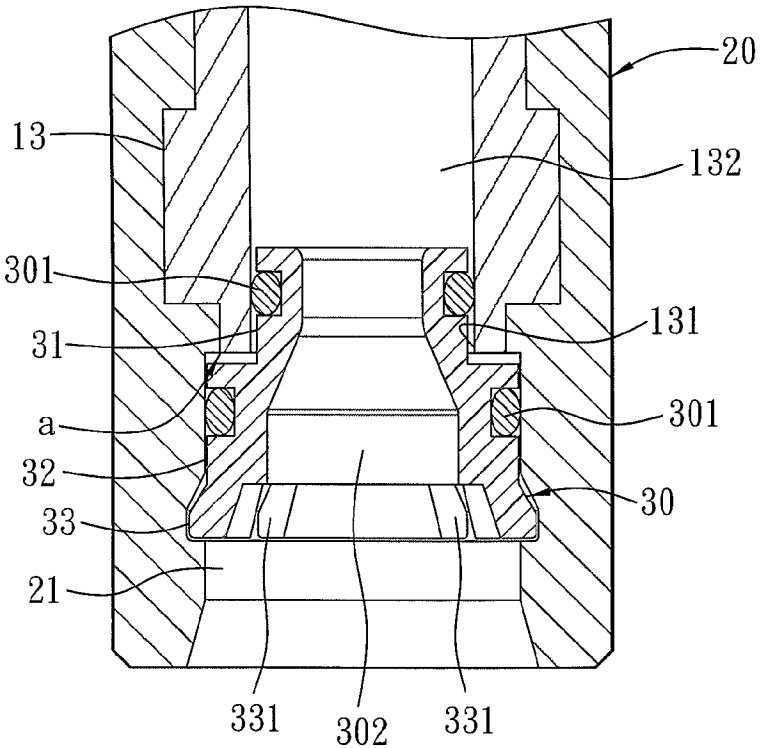
FIG. 3 is a partial cross sectional view showing the assembly of a faucet body of the first embodiment of the present invention being fixed in a plastic sleeve.

FIGS. 1-3 show a plastic faucet body with copper connecting legs according to a first embodiment of the present invention. A faucet body 1 comprises a plastic member 10 and two copper connecting legs 20.

Figure 4:
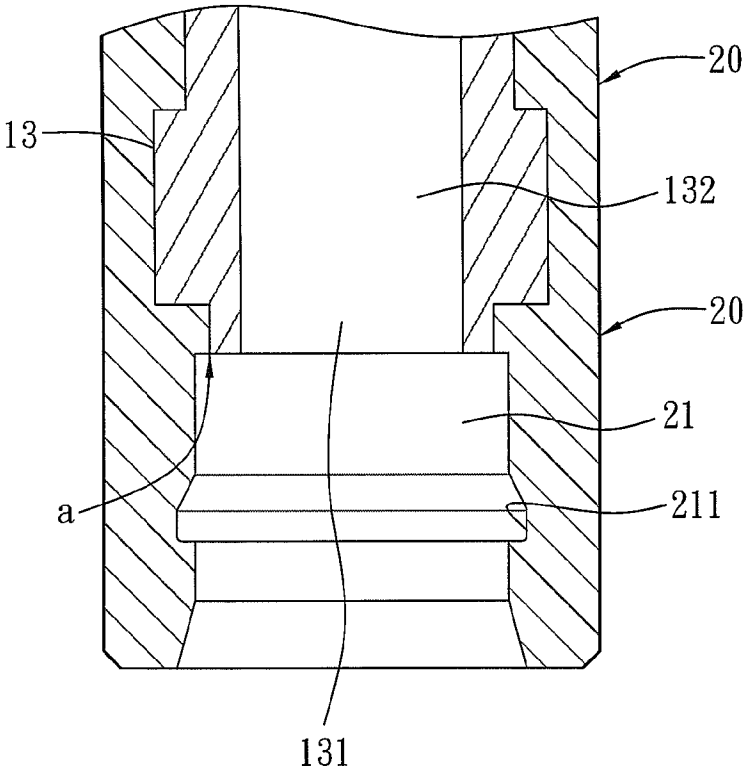
FIG. 4 is a partial cross sectional showing the assembly of two copper connecting legs and two support feet according to the first embodiment of the present invention.

The plastic member 10 is injection molded from plastic material and includes two seat portions 11 mounted on two sides thereof, a connecting portion 12 defined between the two seat portions 11, and two support feet 13 extending downwardly from two bottom ends of the two seat portions 11. As shown in FIG. 4, each support foot 13 has an inlet 131 formed on a bottom end thereof and has a channel 132 arranged in the each support foot 13 and communicating with each seat portion 11. The connecting portion 12 has at least one exit 121 defined on a middle section thereof and has a tunnel 122 defined therein and communicating with the each seat portion 11.

The two copper connecting legs 20 are made of cooper material, and each copper connecting leg 20 is engaged on an outer wall of the each support foot 13 of the plastic member 10 and has a threaded section 201 formed on the outer wall thereof.

Figure 5:
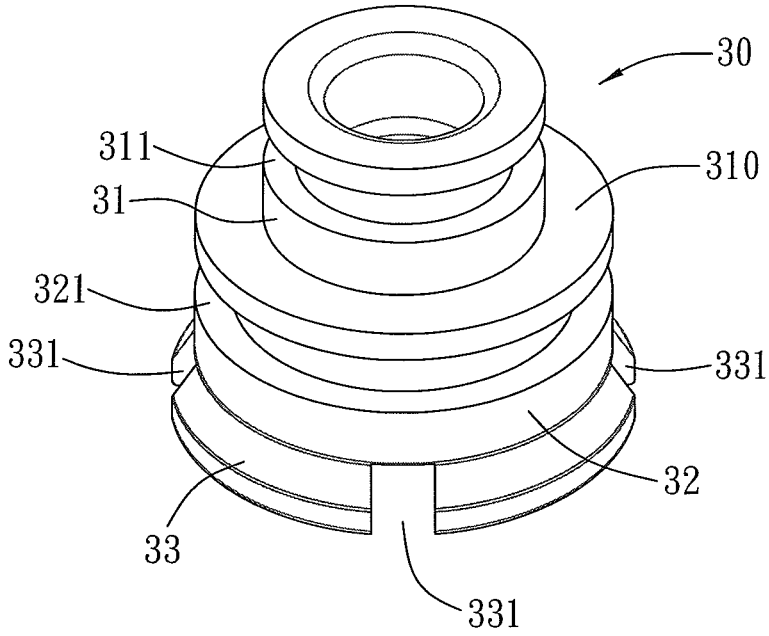
FIG. 5 is a perspective view showing the assembly of the plastic faucet body with copper connecting according to the first embodiment of the present invention.
Figure 6:
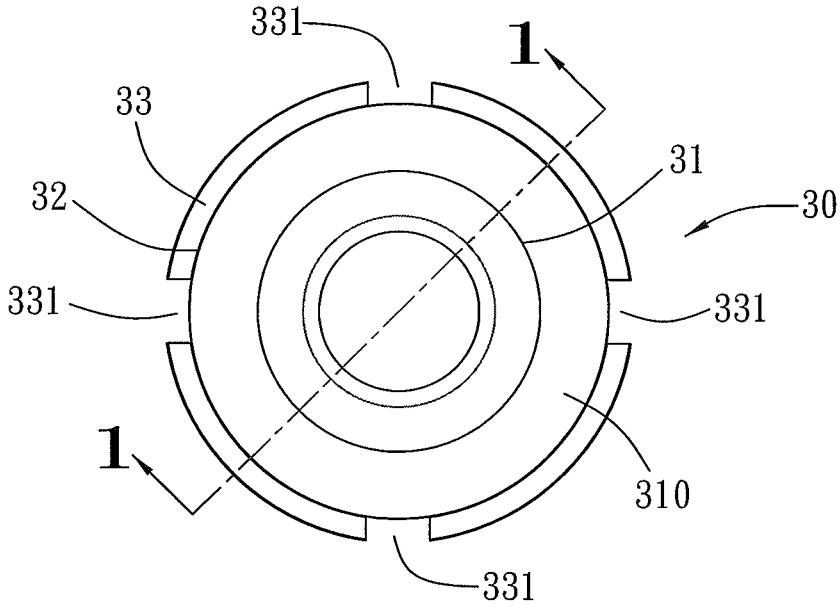
FIG. 6 is a plan view showing the assembly of the plastic faucet body with copper connecting according to the first embodiment of the present invention.
Figure 7:
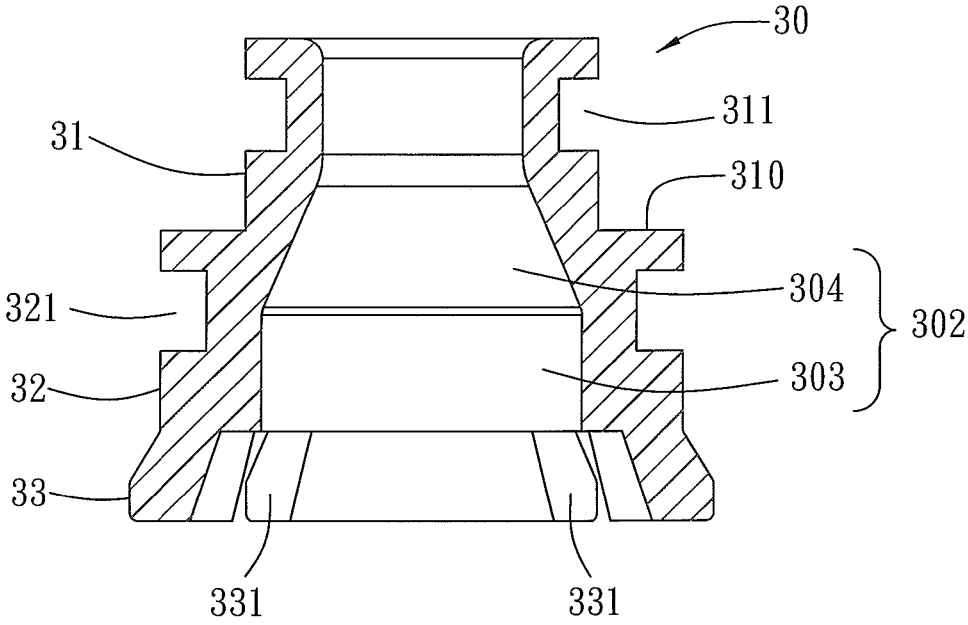
FIG. 7 is a cross sectional view taken along the line 1-1 of FIG. 6.

An improvement of the plastic faucet body of the present invention contains:

a bottom end of the each copper connecting leg 20 extending a predetermined distance from a bottom end of the each support foot 13 so as to define a fitting section 21 on an inner wall of the each copper connecting leg 20, as illustrated in FIGS. 3 and 4;

a lower coupling portion a formed on a connection zone of the bottom end of the each support foot 13 and the inner wall of the each copper connecting leg 20;

a plastic sleeve 30, as shown in FIGS. 5-7, its at least one part is engaged with the fitting section 21 of the each copper connecting leg 20, the plastic sleeve 30 having two seal elements 301 fitted on an outer wall thereof so as to provide a sealing effect and to prevent water from leakage via the lower coupling portion a and having a seal inner face 302 formed on an inner wall of the plastic sleeve 30 so as to connect with a flat surface or a conical portion of a cold water pipe or a hot water pipe. To facilitate a contact of the flat surface or the conical portion of the cold water pipe or the hot water pipe with the seal inner face 302, the seal inner face 302 has a circularly groove-shaped face 303 arranged on a lower end thereof and a conically inner face 304 connecting with an upper end of the circularly groove-shaped face 303.

The plastic sleeve 30 is formed in a plug shape and includes an upper closing portion 31, a lower closing portion 32 connecting with a bottom end of the upper closing portion 31, and a flexible retaining portion 33 coupling with a bottom end of the lower closing portion 32. A diameter of the upper closing portion 31 is smaller than that of the lower closing portion 32, so the upper closing portion 31 is placed into the channel 132 from the bottom end of the each support foot 13, and the lower closing portion 32 is engaged in the fitting section 21 of the each copper connecting leg 20. Also, between a connection zone of the upper closing portion 31 and the lower closing portion 32 is defined a stepped tab 310 relative to the lower coupling portion a.

The upper closing portion 31 has a first peripheral recess 311 defined on an outer wall thereof, and the lower closing portion 32 has a second peripheral recess 321 defined on an outer wall thereof, such that one of the two seal elements 301 (such as a rubber seal ring) is fitted in the first peripheral recess 311 and contacts with an inner wall of the each support foot 13 adjacent to the bottom end of the each support foot 13, and another of the two seal elements 301 is fitted in the second peripheral recess 321 and contacts with an inner wall of the fitting section 21 of the each copper connecting leg 20. Since the lower coupling portion a is defined between the two seal elements 301, the water does not permeate into the lower coupling portion a, thus further preventing the water from leakage via the lower coupling portion a.

To fix the plastic sleeve 30 securely, the fitting section 21 of the each copper connecting leg 20 has a peripheral slot 211 formed on the inner wall thereof so as to engage with the flexible retaining portion 33. The flexible retaining portion 33 of the plastic sleeve 30 has a plurality of notches 331 arranged around an external rim thereof and spaced apart from each other so that the flexible retaining portion 33 retracts and expands flexibly, such that after the flexible retaining portion 33 is pressed, it flexibly retracts into the plurality of notches 331, and after a pressing force diminishes completely or partially, the flexible retaining portion 33 flexibly expands and then retains in the plurality of notches 331. In assembly, the plastic sleeve 30 is forced upwardly to the each copper connecting leg 20 so that the bottom end of the each copper connecting leg 20 retains into the plurality of notches 331 of the flexible retaining portion 33, thus assembling the plastic sleeve 30.

Figure 8:
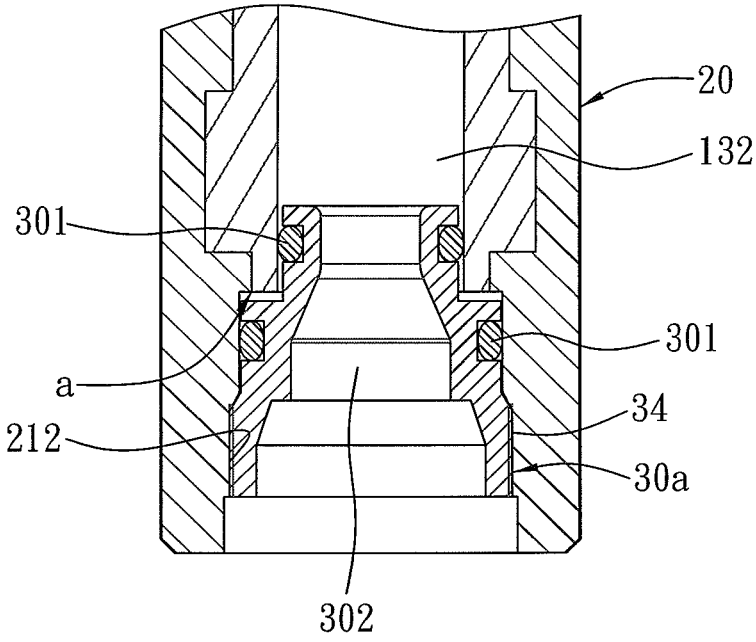
FIG. 8 is a partial cross sectional view showing a plastic sleeve fixed in a faucet body according to a second embodiment of the present invention.

Referring further to FIG. 8, a difference of a plastic faucet body with copper connecting legs of a second embodiment of the present invention from that of the first embodiment comprises:

a plastic sleeve 30*a* having an external screwing section 34 for replacing the flexible retaining portion 33 of the first embodiment and having an internal screwing section 212 formed on a fitting section 21 of each of two copper connecting legs 20 so as to replace the peripheral slot 211 of the first embodiment, such that the external screwing section 34 of the plastic sleeve 30*a* screws with the internal screwing section 212 of the fitting section 21, thus connecting the plastic sleeve 30*a* with the each of two copper connecting legs 20

Figure 9:
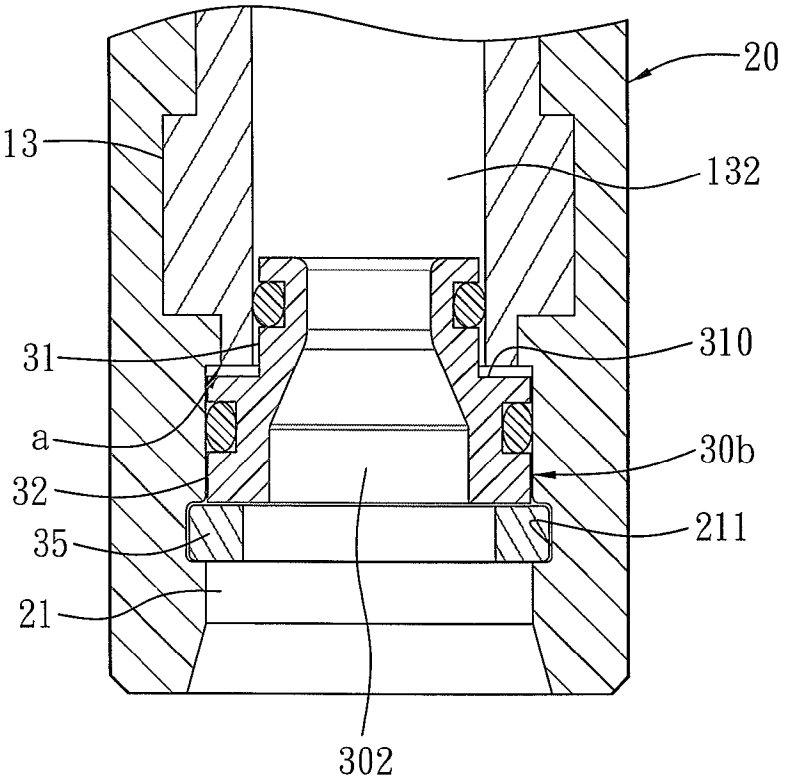
FIG. 9 is a partial cross sectional view showing a plastic sleeve fixed in a faucet body according to a third embodiment of the present invention.

As shown in FIG. 9, a difference of a plastic faucet body with copper connecting legs of a third embodiment of the present invention from that of the first embodiment comprises:

a plastic sleeve 30*b* having a flexible locking element 35 for replacing the flexible retaining portion 33 of the first embodiment, wherein the locking element 35 is a C-shaped snap ring or an E-shaped snap ring, etc. The plastic faucet body of this third embodiment also comprises a peripheral slot 211 of a fitting section 21 of each of two copper connecting legs 20 so as to retain with the locking element 35, such that the plastic sleeve 30*b* is limited to axially move downward. Also, between a connection zone of an upper closing portion 31 and a lower closing portion 32 of the plastic sleeve 30*b* is defined a stepped tab 310, so the plastic sleeve 30*b* axially moves upward. Thereby, the plastic sleeve 30*b* is limited in the fitting section 21.

Figure 10:
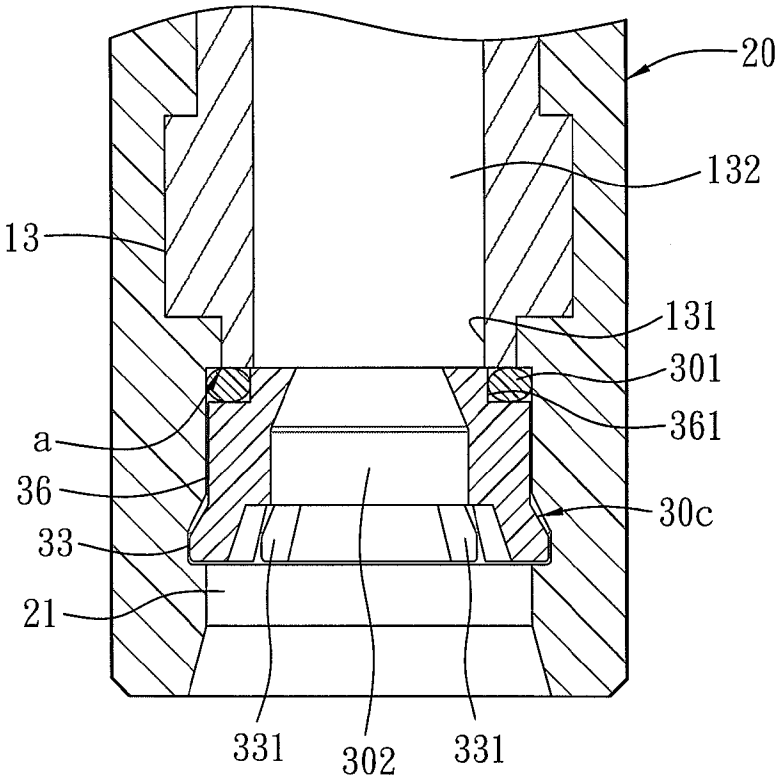
FIG. 10 is a partial cross sectional view showing a plastic sleeve fixed in a faucet body according to a fourth embodiment of the present invention.

As shown in FIG. 10, a difference of a plastic faucet body with copper connecting legs of a fourth embodiment of the present invention from that of the first embodiment comprises:

a plastic sleeve 30*c* having a closing portion 31 identical to the lower closing portion 32 of the first embodiment without the upper closing portion 31 of the first embodiment, and the closing portion 31 having a stepped trench 361 defined on an outer wall of a top end thereof so as to engage a seal element 301 (such as a rubber seal ring). In addition, a position of the stepped trench 361 of this fourth embodiment is different from that of the first peripheral recess 311 of the first embodiment, such that the seal element 301 of the fourth embodiment closes a lower coupling portion a of the fourth embodiment, thus preventing water from leakage.

Unlike conventional faucet body with copper connecting legs, a length of the each copper connecting leg 20 of the prevent invention is longer than that of the each support foot 13 of the prevent invention so that the each copper connecting leg 20 has the fitting section 21, and the connection zone of the bottom end of the each support foot 13 and the inner wall of the each copper connecting leg 20 (i.e., the lower coupling portion a) is moved to a more upper position. Accordingly, when the fitting section 21 of the each copper connecting leg 20 connects with the plastic sleeve 30, one or two seal elements 301 of the plastic sleeve 30 are used to prevent water, flowing through the channel 132 of the each support foot 13, from contacting with the lower coupling portion a, thus avoiding water from leakage via the lower coupling portion a.

In addition, the plastic sleeves except for that of the fourth embodiment are engaged with the fitting section 21 of the each copper connecting leg 20 and in the channel 132 of the each support foot 13. Thereby, the plastic sleeve 30 is partially or completely engaged in the fitting section 21.

Figure 12:
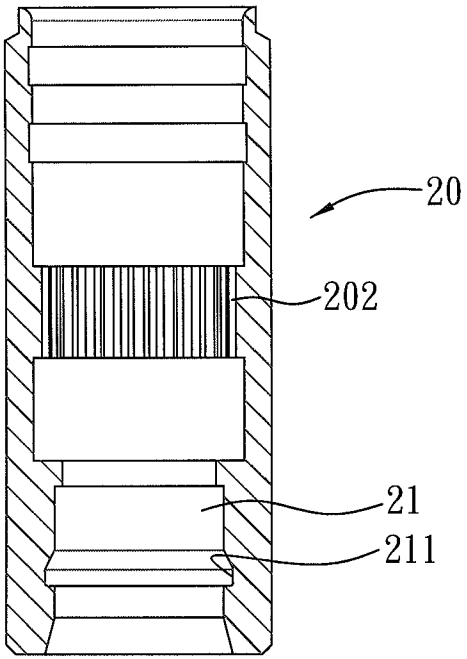
FIG. 12 is a cross sectional view taken along the line 2-2 of FIG. 11.
Figure 11:
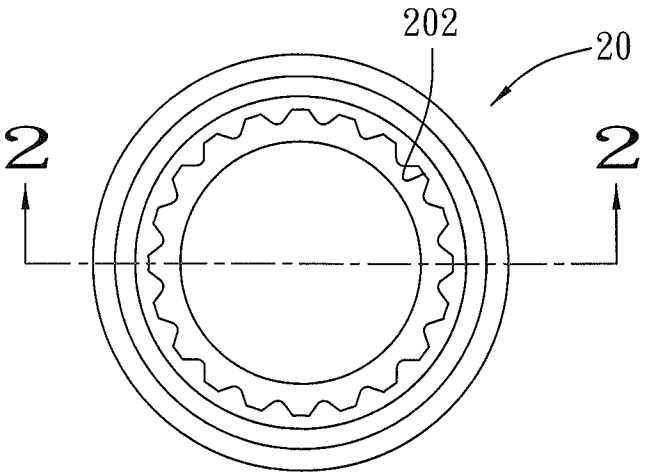
FIG. 11 is a plan view showing the assembly of a copper connecting leg of the faucet body according to the present invention.

To avoid a disengagement of the two copper connecting legs 20 from the each support foot 13, as shown in FIGS. 11 and 12, an anti-rotation structure is provided between the two copper connecting legs 20 and the each support foot 13. The anti-rotation structure includes a plurality of vertical troughs 202 formed around a middle section of the inner wall of the each copper connecting leg 20 so as to retain with the each support foot 13.

Figure 13:
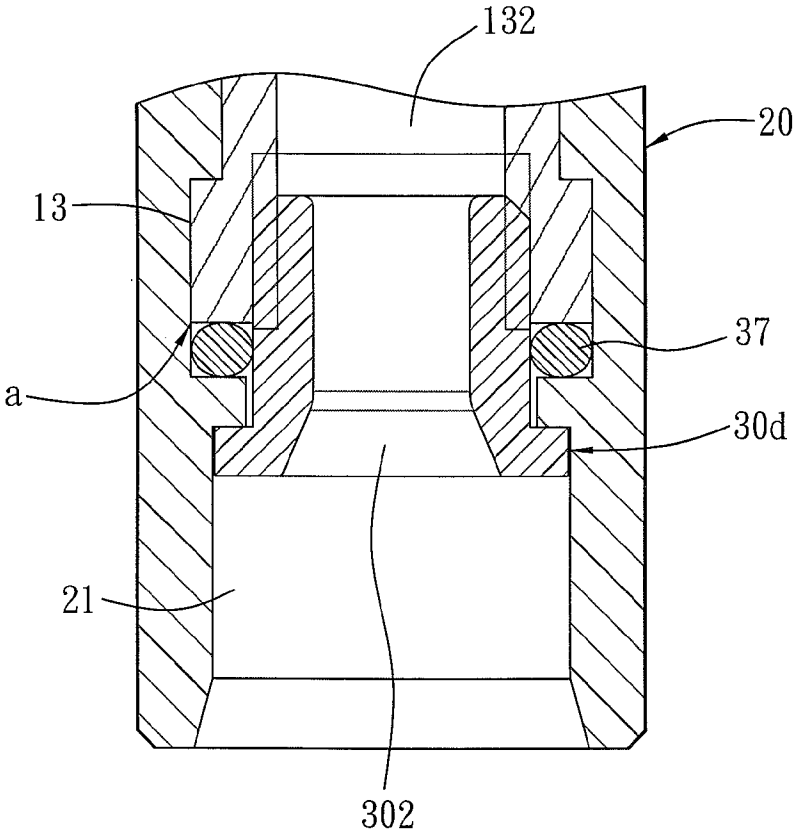
FIG. 13 is a partial cross sectional view showing a plastic sleeve fixed in a faucet body according to a fifth embodiment of the present invention.

As illustrated in FIG. 13, a plastic faucet body with copper connecting legs according to a fifth embodiment of the present invention comprises: a sealing pad 37 or an O-shaped ring fixed between a bottom end of each support foot 13 and each connecting leg 20 when the each support foot 13 retains with the each connecting leg 20, and a plastic sleeve 30*d* is screwed into a channel 132 of the each support foot 13 so as to limit the sealing pad 37 or the O-shaped ring and to form a seal inner face 302, thus obtaining a sealing effect as well.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A plastic faucet body with copper connecting legs comprising:

a plastic member injection molded from plastic material and includes two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end of the each copper connecting leg extends a predetermined distance from a bottom end of the each support foot so as to define a fitting section on an inner wall of the each copper connecting leg;

a lower coupling portion is formed on a connection zone of the bottom end of the each support foot and the inner wall of the each copper connecting leg;

a plastic sleeve, at least one part of which is engaged with the fitting section of the each copper connecting leg, the plastic sleeve has at least one seal element fitted on an outer wall thereof so as to provide a sealing effect and to prevent water from leakage via the lower coupling portion and has a seal inner face formed on an inner wall of the plastic sleeve.

2. The plastic faucet body with copper connecting legs as claimed in claim 1, characterized in that the at least one seal element is a rubber seal ring.

3. The plastic faucet body with copper connecting legs as claimed in claim 1, characterized in that the plastic sleeve is formed in a plug shape and includes an upper closing portion, a lower closing portion connecting with a bottom end of the upper closing portion, and a flexible retaining portion coupling with a bottom end of the lower closing portion; one of the at least one seal element is fitted on an outer wall of the upper closing portion, and another of the at least one seal element is fitted on an outer wall of the lower closing portion, such that the at least one seal element contact with an inner wall of the each support foot adjacent to the bottom end of the each support foot and an inner wall of the fitting section of the each copper connecting leg; the fitting section of the each copper connecting leg has a peripheral slot formed on the inner wall of the fitting section so as to engage with the flexible retaining portion of the plastic sleeve.

4. The plastic faucet body with copper connecting legs as claimed in claim 3, characterized in that a diameter of the upper closing portion of the plastic sleeve is smaller than that of the lower closing portion, and between a connection zone of the upper closing portion and the lower closing portion is defined a stepped tab relative to the lower coupling portion; the flexible retaining portion of the plastic sleeve has a plurality of notches arranged around an external rim thereof and spaced apart from each other, such that after the flexible retaining portion is pressed, it flexibly retracts into the plurality of notches and flexibly expands and then retains in the plurality of notches.

5. The plastic faucet body with copper connecting legs as claimed in claim 3, characterized in that the upper closing portion of the plastic sleeve has a first peripheral recess defined on the outer wall thereof, and the lower closing portion has a second peripheral recess defined on the outer wall thereof; the at least one seal element is a rubber seal ring fitted in the first peripheral recess and the second peripheral recess.

6. The plastic faucet body with copper connecting legs as claimed in claim 1, characterized in that characterized in that the plastic sleeve is formed in a plug shape and includes an upper closing portion, a lower closing portion connecting with a bottom end of the upper closing portion, and an external screwing section coupling with a bottom end of the lower closing portion; one of the at least one seal element is fitted on an outer wall of the upper closing portion, and another of the at least one seal element is fitted on an outer wall of the lower closing portion, such that the at least one seal element contact with an inner wall of the each support foot adjacent to the bottom end of the each support foot and an inner wall of the fitting section of the each copper connecting leg; the fitting section of the each copper connecting leg has an internal screwing section formed on the inner wall of the fitting section so as to screw with the external screwing section of the plastic sleeve.

7. The plastic faucet body with copper connecting legs as claimed in claim 6, characterized in that a diameter of the upper closing portion of the plastic sleeve is smaller than that of the lower closing portion, and between a connection zone of the upper closing portion and the lower closing portion is defined a stepped tab relative to the lower coupling portion; the upper closing portion of the plastic sleeve has a first peripheral recess defined on an outer wall thereof, and the lower closing portion has a second peripheral recess defined on an outer wall thereof; the at least one seal element is a rubber seal ring fitted in the first peripheral recess and the second peripheral recess.

8. The plastic faucet body with copper connecting legs as claimed in claim 1, characterized in that the plastic sleeve has a flexible locking element; the plastic sleeve is formed in a plug shape and includes an upper closing portion and a lower closing portion connecting with a bottom end of the upper closing portion; one of the at least one seal element is fitted on an outer wall of the upper closing portion, and another of the at least one seal element is fitted on an outer wall of the lower closing portion, such that the at least one seal element contact with an inner wall of the each support foot adjacent to the bottom end of the each support foot and an inner wall of the fitting section of the each copper connecting leg; the fitting section of the each copper connecting leg has a peripheral slot formed on the inner wall of the fitting section so as to engage with the flexible retaining portion of the plastic sleeve, such that the plastic sleeve is limited by the flexible locking element so as to axially move downward.

9. The plastic faucet body with copper connecting legs as claimed in claim 8, characterized in that a diameter of the upper closing portion of the plastic sleeve is smaller than that of the lower closing portion, and between a connection zone of the upper closing portion and the lower closing portion is defined a stepped tab relative to the lower coupling portion so ax to limit the plastic sleeve to axially move upward; the upper closing portion of the plastic sleeve has a first peripheral recess defined on the outer wall thereof, and the lower closing portion has a second peripheral recess defined on the outer wall thereof; the at least one seal element is a rubber seal ring fitted in first peripheral recess and the second peripheral recess; the flexible locking element is a C-shaped snap ring.

10. The plastic faucet body with copper connecting legs as claimed in claim 1, characterized in that the plastic sleeve is formed in a plug shape and includes a closing portion and a flexible locking element connecting with a bottom end of the closing portion; one of the at least one seal element is fitted on an outer wall of the upper closing portion, and another of the at least one seal element is fitted on an outer wall of the lower closing portion, such that the at least one seal element contact with an inner wall of the each support foot adjacent to the bottom end of the each support foot and an inner wall of the fitting section of the each copper connecting leg; the fitting section of the each copper connecting leg has a peripheral slot formed on the inner wall of the fitting section so as to engage with the flexible retaining portion of the plastic sleeve, such that the plastic sleeve is limited by the flexible locking element so as to axially move downward; the closing portion has a seal element for closing the lower coupling portion.

11. The plastic faucet body with copper connecting legs as claimed in claim 10, characterized in that the flexible retaining portion of the plastic sleeve has a plurality of notches arranged around an external rim thereof and spaced apart from each other, such that after the flexible retaining portion is pressed, it flexibly retracts into the plurality of notches and flexibly expands and then retains in the plurality of notches.

12. The plastic faucet body with copper connecting legs as claimed in claim 10, characterized in that the closing portion of the plastic sleeve has a stepped trench defined on an outer wall of a top end thereof; the at least one seal element is a rubber seal ring fitted in the stepped trench.

* * * * *